US007394074B2

(12) United States Patent
Balestracci

(10) Patent No.: US 7,394,074 B2
(45) Date of Patent: Jul. 1, 2008

(54) PROTECTIVE HOUSING FOR RADIONUCLIDE GENERATOR AND COMBINATION THEREOF

(75) Inventor: Ernest Balestracci, Iselin, NJ (US)

(73) Assignee: Bracco Diagnostics Inc., Princeton, NJ (US)

( * ) Notice: Subject to any disclaimer, the term of this patent is extended or adjusted under 35 U.S.C. 154(b) by 755 days.

(21) Appl. No.: 10/928,635

(22) Filed: Aug. 28, 2004

(65) Prior Publication Data

US 2006/0045229 A1 Mar. 2, 2006

(51) Int. Cl.
*G21F 5/00* (2006.01)

(52) U.S. Cl. ..... 250/432 PD; 250/432; 250/356.2; 250/506.1; 423/2; 423/3; 423/6; 423/249; 252/645

(58) Field of Classification Search ..... 250/432, 250/506.1, 356.2, 432 PD; 423/2, 3, 6, 249; 252/645

See application file for complete search history.

(56) References Cited

U.S. PATENT DOCUMENTS 4,239,970 A * 12/1980 Eckhardt et al. ..... 250/432 PD
5,109,160 A * 4/1992 Evers ..... 250/432 PD

* cited by examiner

*Primary Examiner*—Jack I. Berman
*Assistant Examiner*—Meenakshi S Sahu
(74) *Attorney, Agent, or Firm*—M. Caragh Noone

(57) ABSTRACT

A protective cover and radionuclide generator assembly. The cover protecting inlet and outlet connections disposed on the radionuclide generator. The radionuclide generator having a distal end having a generally flat top surface. The protective cover removably fixed at the distal end and positioned over the generally flat top surface. The protective cover engaging with the radionuclide generator and providing an interference fit. The interference fit preventing the removal of the cover from the radionuclide generator, unless so desired by a user. The cover being made from a radioactive resistant polypropylene.

15 Claims, 6 Drawing Sheets

PROTECTIVE HOUSING FOR RADIONUCLIDE GENERATOR AND COMBINATION THEREOF

FIELD OF THE INVENTION

The present invention relates to a protective housing for a radionuclide generator. More particularly, the invention relates to a protective housing that covers and protects the inlet and outlet connections of the radionuclide generator.

BACKGROUND OF THE INVENTION

The use of radionuclides for the diagnosis and treatment of various medical conditions is widespread. In diagnostic procedures it is desirable for a diagnostician to be able to clearly view the tissue of interest, such as, for example, a patient's heart. Some radioactive isotopes have an extremely short half-life. Thus, using them is very desirable in diagnosis since they minimize prolonged radiation exposure to the patient, but provide clear images to the medical diagnostician.

In practice, these desirable radioactive isotopes are often provided by a radionuclide nuclear generator, such as Bracco Diagnostic's model Cardiogen 82 (Rubidium RB 82 Generator), model #001500. The radionuclide generators are typically used up to 168 times in a one month time frame.

The generator typically includes an inlet connection and an outlet connection. Since the generator may be used up to 168 times the connections often get crushed or kinked. If the inlet or outlet connection becomes damaged, the generator will be rendered unusable. Therefore, it would be desirable to provide a protective cover that prevents the inlet and outlet connections from becoming damaged in combination with the radionuclide generator.

SUMMARY OF THE INVENTION

In accordance with the present invention, a radionuclide generator assembly is provided. The radionuclide generator assembly includes a radionuclide generator that has a distal end and a protective cover that is removably fixed at the distal end. The protective cover comprises a radioactive resistant polypropylene.

In another embodiment of the present invention a cover and radionuclide generator assembly is provided. The radionuclide generator assembly includes a radionuclide generator. The radionuclide generator includes a bucket and a distal end that has a generally flat top surface. The cover includes a protective cover that is removably fixed and positioned over the generally flat top surface.

In another embodiment of the present invention a protective cover for a radionuclide generator is provided. The cover provides a housing which covers the inlet and outlet ports of the radionuclide generator and struts for releasably engaging the radionuclide generator.

In another embodiment of the present invention a protective cover for a radionuclide generator is provided. The cover includes a generally rectangular housing that has a distal end, a generally flat top surface, a first pair of side portions connected to the top surface, a second pair of side portions connected to the top surface. The cover also includes a semicircular notch that is disposed on each of the pair of first side portions, a bottom surface that is connected to the first and second pairs of side portions and at least two struts that are connected to the bottom surface and project away from the generally flat top surface.

In another embodiment the above referenced cover may optionally be combined with a radionuclide generator. The radionuclide generator having an inlet port entering the radionuclide generator from a generally flat top surface, an outlet port exiting the radionuclide generator from a generally flat top surface and a u-shaped handle connected to the bucket. The u-shaped handle having a bottom portion and a semicircular top portion that is designed to be contiguous with the semicircular notch that is disposed on each of the first pair of side portions of the protective cover.

The at least two struts may optionally provide a ribbed portion. The ribbed portion of the at least two struts engage the bottom portion of the handle of the bucket such that the engagement prevents the cover from being removed from the handle.

The at least two struts may optionally provide four struts and each of the four struts may optionally provide a ribbed portion.

In another embodiment of the present invention a combination protective cover and a radionuclide generator assembly is provided. The assembly includes a radionuclide generator that has a bucket and a distal end having two generally flat top surfaces. The two generally flat top surfaces having a first distance $D_1$. The radionuclide generator further includes an inlet port that enters from the generally flat top surface, an outlet port that exits from the generally flat top surface and a handle that is connected to the bucket. The handle provides a bottom portion and a semicircular top portion. The semicircular top portion has a third distance $D_3$.

The protective cover is positioned over the inlet and outlet ports, the semicircular top portion of the handle and the generally flat top surface of the distal end. The protective cover provides a generally rectangular housing that has a top portion and a first pair of side portions having corresponding inner surfaces. The first pair of side portions are connected to the top portion and have a second distance $D_2$ that lies between the inner surfaces. The generally rectangular housing also provides a second pair of side portions that are connected to the top portion, a semicircular notch on each of the first pair of side portions and a bottom surface that is connected to the first and second pairs of side portions.

The protective cover also provides at least two struts that are connected to the bottom surface. The at least two struts project away from the top portion. The at least two struts have an outer surface and a fourth distance $D_4$ that lies between the outer surfaces. The first distance $D_1$ is about equal to the second distance $D_2$ and the third distance $D_3$ is about equal to the fourth distance $D_4$. The about equal distances $D_1$ and $D_2$ provide an interference fit between the at least two struts and the generally rectangular top surface. The about equal distances $D_3$ and $D_4$ provide an interference fit between the outer surfaces of the struts and the semicircular top portion of the handle.

In another embodiment of the present invention a combination protective cover and a radionuclide generator assembly is provided. The assembly includes a radionuclide generator that has a bucket, a distal end having two generally flat top surfaces. The two generally flat top surfaces having a first distance $D_1$. The radionuclide generator further includes an inlet port that enters from the generally flat top surface, an outlet port that exits from the generally flat top surface and a handle that is connected to the bucket. The handle provides a bottom portion and a semicircular top portion. The semicircular top portion has a third distance $D_3$.

The protective cover is positioned over the inlet and outlet ports, the semicircular top portion of the handle and the generally flat top surface of the distal end. The protective cover provides a generally rectangular housing that has a top portion and a first pair of side portions having corresponding inner surfaces. The first pair of side portions are connected to the top portion and have a second distance $D_2$ that lies between the inner surfaces. The generally rectangular housing also provides a second pair of side portions that are connected to the top portion, a semicircular notch on each of the first pair of side portions and a bottom surface that is connected to the first and second pairs of side portions.

The protective cover also provides at least two struts that are connected to the bottom surface. The at least two struts project away from the top portion and have an outer surface, a rib disposed on the outer surface and a fourth distance $D_4$ lying between the outer surfaces. The first distance $D_1$ is about equal to the second distance $D_2$ and the third distance $D_3$ is about equal to the fourth distance $D_4$. The about equal distances $D_1$ and $D_2$ provide an interference fit between the at least two struts and the generally rectangular top surface. The about equal distances $D_3$ and $D_4$ provide an interference fit between the outer surfaces of the struts and the semicircular top portion of the handle. The ribbed portion of each strut latches and engages the bottom portion of the handle such that the engagement prevents removal of the cover from the radionuclide generator.

DETAILED DESCRIPTION OF THE INVENTION

Figure 1:
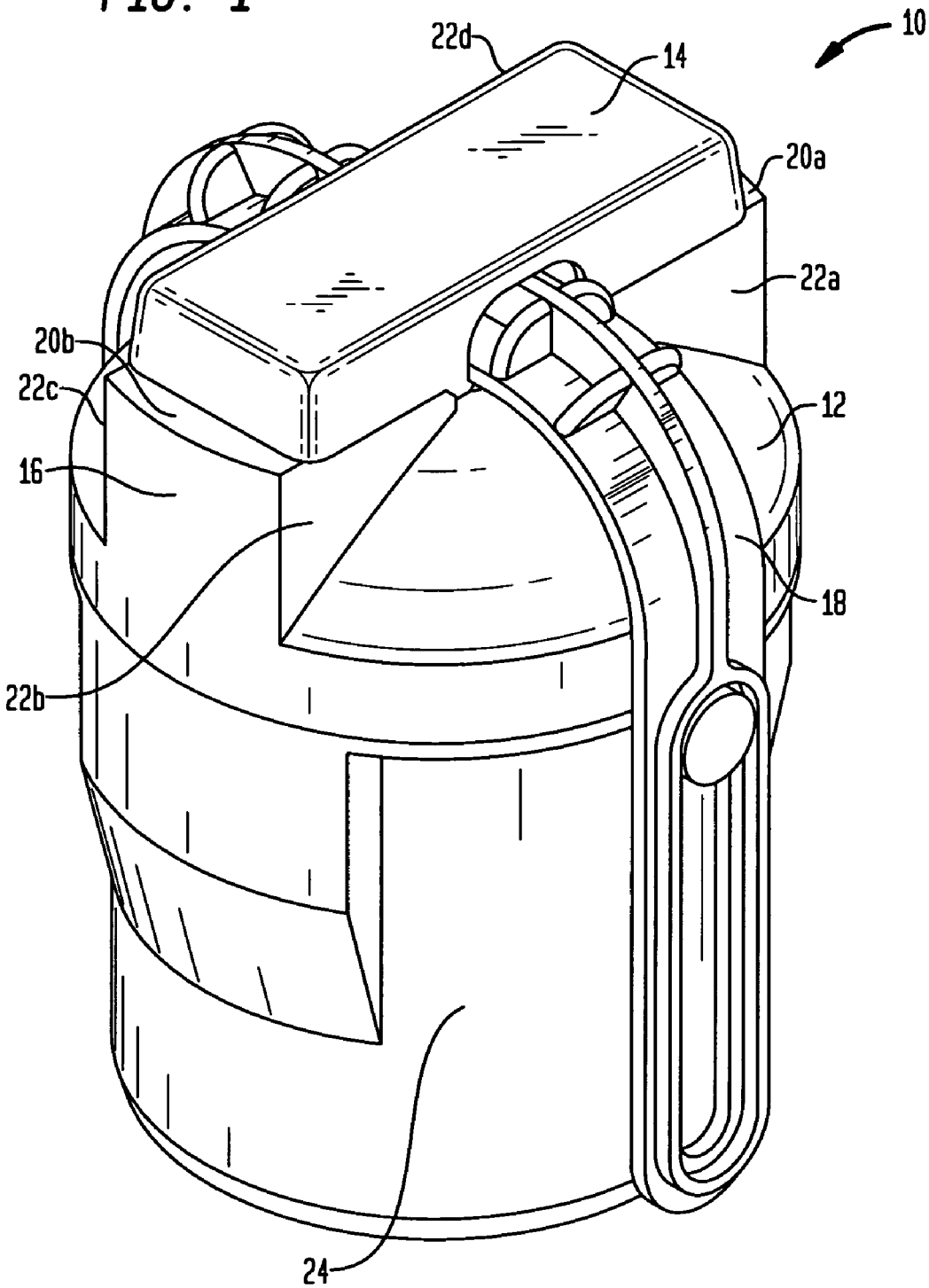
FIG. 1 is a perspective view of the protective housing and radionuclide generator in combination.

While the invention includes embodiments in many different forms, there is shown in the drawings and will herein be described in detail preferred embodiments of the invention with the understanding that the present disclosure is to be considered as exemplary of the principles of the invention and is not intended to limit the invention to the embodiments illustrated.

Referring to FIG. 1, there is shown in perspective view a radionuclide generator assembly of the present invention. Radionuclide generator assembly 10 comprises a protective housing or cover 14 of the invention and a radionuclide generator 12. Radionuclide generator 12 includes a distal end 16, a u-shaped handle 18 and a bucket 24 that contains a lead liner (not shown) and a column containing the radionuclide (not shown).

For purposes of the description of the radionuclide generator and present invention, the term "distal end" refers to the end closest to the end having the inlet and outlet connections, whereas the term "proximal end" refers to the end furthest from the end having the inlet and outlet connections.

Figure 2:
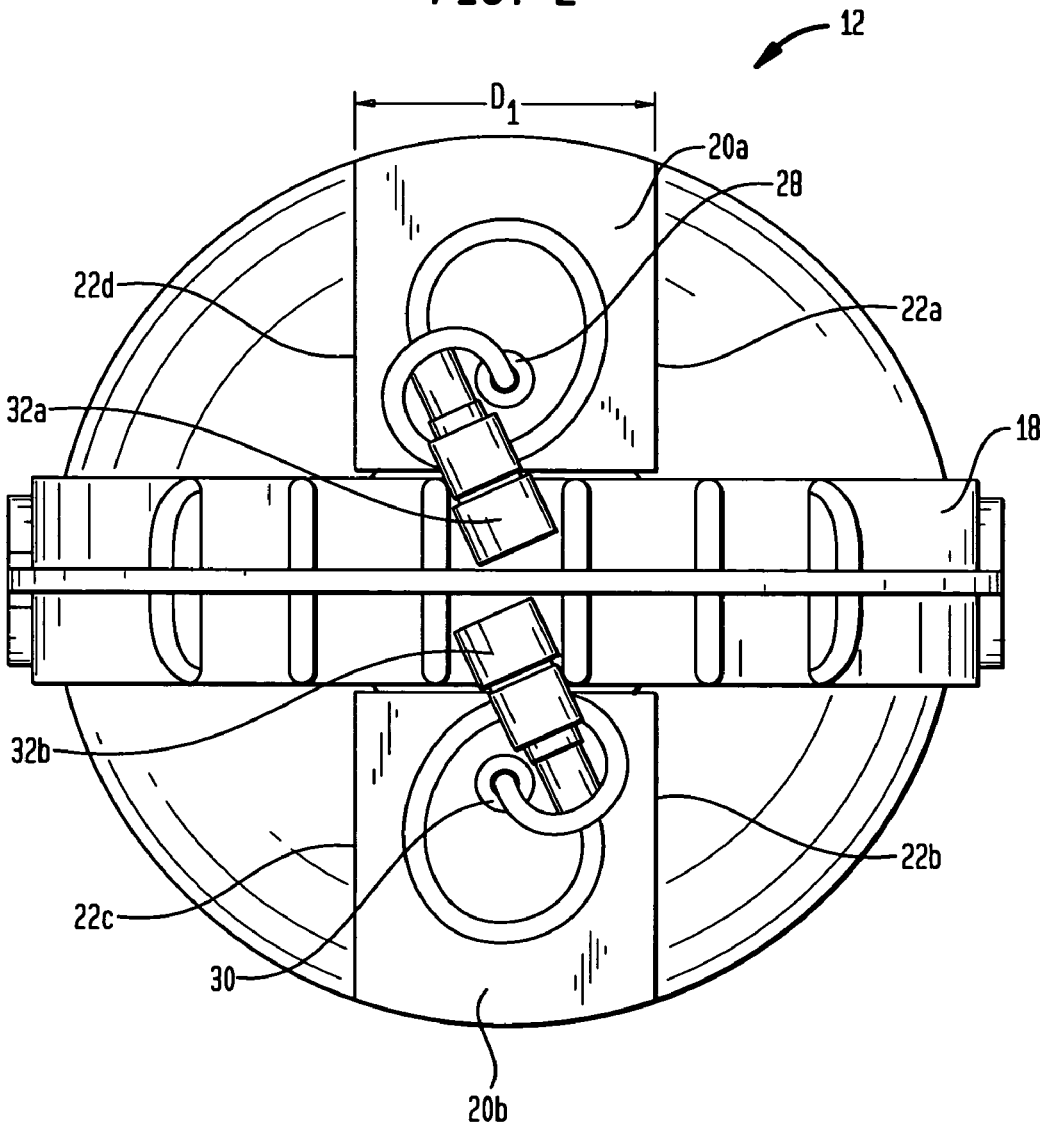
FIG. 2 is a top plan view of the radionuclide generator.

The distal end 16 includes generally flat top surfaces 20*a* and 20*b* and generally flat side surfaces 22*a*, 22*b*, 22*c* and 22*d*. Referring now to FIG. 2, there is shown a top plan view of the radionuclide generator 12. A first distance $D_1$ spans across the generally flat top surfaces 20*a* and 20*b* of the radionuclide generator 12.

Generally flat top surface 20*a* includes an inlet port 28. Saline (not shown) enters the radionuclide generator 12 through an inlet connector assembly 32*a* and activates the radionuclide generator to create the desired isotope, such as, for example, rubidium (not shown). Inlet connector assembly 32*a* enters the radionuclide generator 12 through inlet port 28. Inlet connector assembly 32*a* is directly connected to the column that is housed within the radionuclide generator 12.

Generally flat top surface 20*b* includes an outlet port 30. The radionuclide exits the radionuclide generator 12 through outlet port 30. Outlet connector assembly 32*b* exits the radionuclide generator 12 through outlet port 30. Outlet connector assembly 32*b* is directly connected to the column that is housed within the radionuclide generator 12.

It should be recognized by those skilled in the art that the location of the inlet and outlet ports need not be limited to their exact positions as shown in FIG. 2. That is, they may, for example, be reversed so that the inlet port is in the location of the outlet port and the outlet port is in the location of the inlet port. This applies to the inlet and outlet connections as well.

Figure 3:
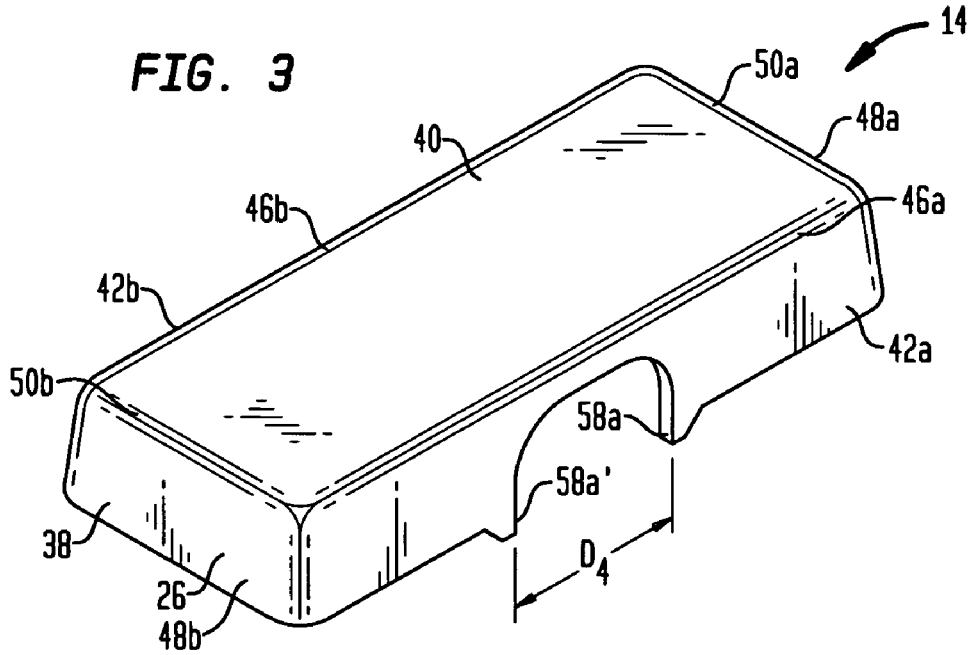
FIG. 3 is a perspective view of a protective housing of the present invention.
Figure 4:
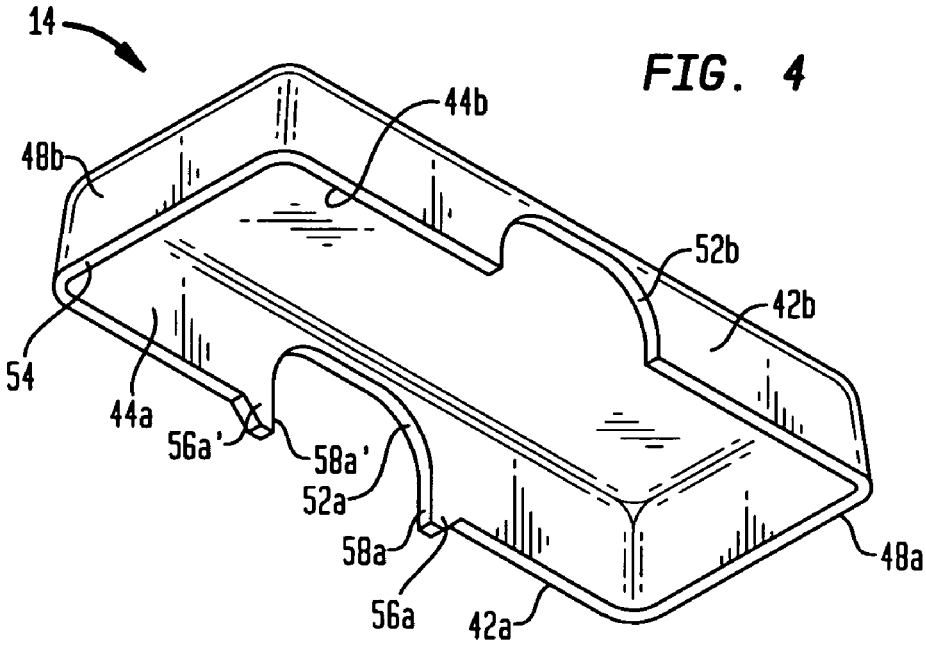
FIG. 4 is a further perspective view of the protective housing of the present invention.

Referring now to FIGS. 3-4; there are shown two separate perspective views of the protective cover 14. The protective cover 14 is made from a radioactive resistant material such as polypropylene. One such supplier of the radioactive resistant polypropylene material is Huntsman Polyurethanes. Huntsman Polyurethanes is located at 2190 Executive Hills Boulevard, Auburn Hills, Mich. 48326. Their material designation for the radioactive resistant polypropylene is Huntsman H1200 PP.

The protective cover 14 includes a housing 38. In a preferred embodiment the housing 38 is generally rectangular; however, the invention includes housings of any shape or configuration sufficient to cover the inlet 28 and outlet 30 ports and to engage with the radionuclide generator such that the cover will only be removed when desired by the user. In a preferred embodiment, the protective cover engages with the radionuclide generator to provide an interference fit such as that described in more detail below.

In the embodiment depicted in FIGS. 3-4, the generally rectangular housing 38 includes a top portion 40 and a first pair of side portions 42*a* and 42*b*. The first pair of side portions 42*a* and 42*b* have corresponding inner surfaces 44*a* and 44*b*. The first pair of side portions 42*a* and 42*b* are connected to the top portion 40 at a first pair of intersections 46*a* and 46*b*.

The generally rectangular housing 38 also includes a second pair of side portions 48*a* and 48*b*. The second pair of side portions 48*a* and 48*b* are connected to the top portion 40 at a second pair of intersections 50*a* and 50*b*. It should be recognized by those skilled in the art that the first pair of intersections 46*a* and 46*b* and the second pair of intersections 50*a* and 50*b* should not be limited to being a particular radius. Additionally, the intersections may optionally be configured to meet to form a right angle.

Figure 5:
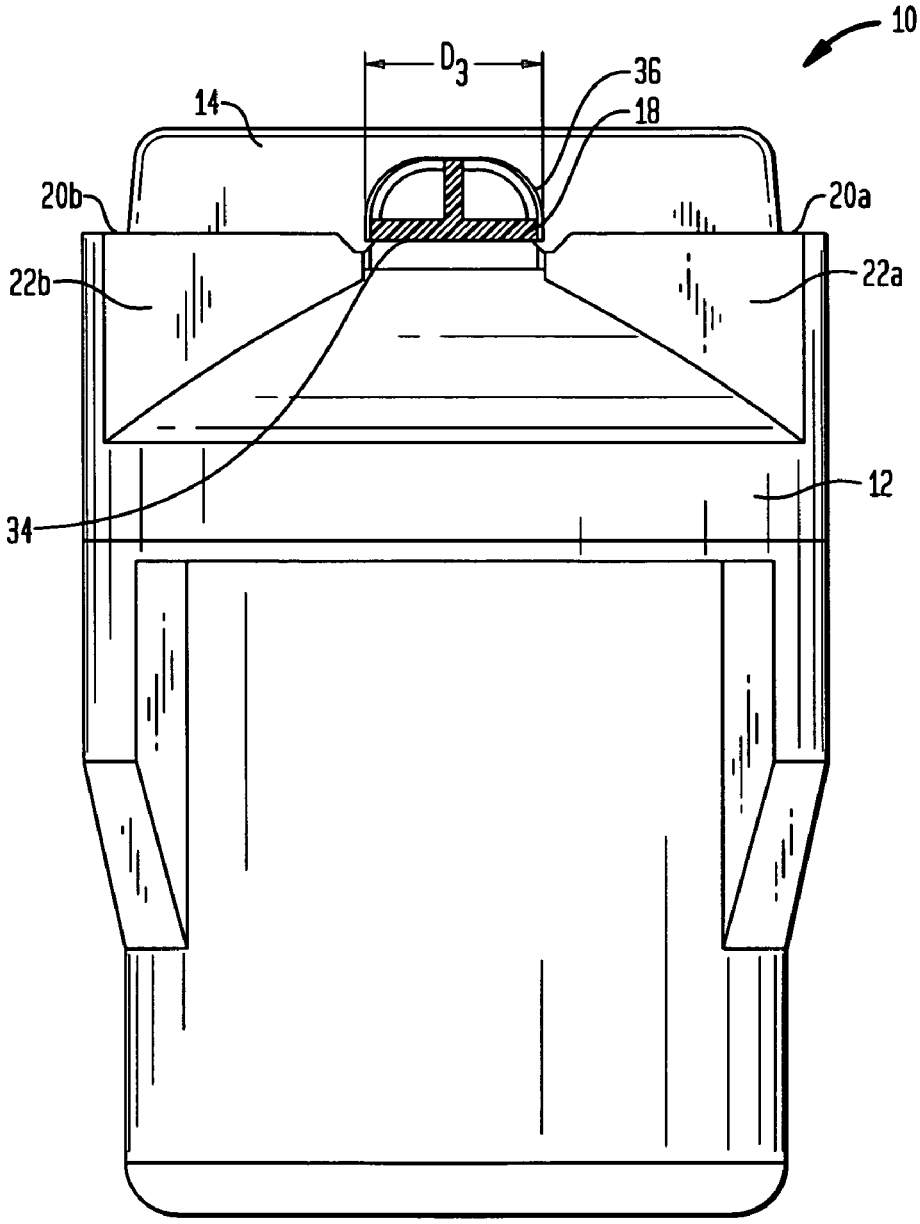
FIG. 5 is a side perspective view of the protective housing and radionuclide generator combination of the present invention.

The first pair of side portions 42*a* and 42*b* each include a semicircular notch 52*a* and 52*b* that is respectively disposed on each of the first pair of side portions. The protective cover 14 also includes a bottom surface 54 that is connected to the first and second pairs of side portions 42*a*, 42*b*, 48*a* and 48*b*. The first side portion 42*a* includes at least two struts 56*a* and 56*a*' that are connected to the bottom surface 54 and semicircular notch 52*a*. The at least two struts 56*a* and 56*a*' project away from the top portion 40. The at least two struts 56*a* and 56*a*' have outer surfaces 58*a* and 58*a*' respectively. A fourth distance $D_4$ spans across the outer surfaces 58*a* and 58*a*'. One embodiment is illustrated in FIGS. 1-5. FIG. 5 shows a side perspective view of the radionuclide assembly 10 of the present invention. The u-shaped handle 18 includes a bottom portion 34 and a semicircular top portion 36. A third distance $D_3$ spans across the semicircular top portion 36 of the handle 18.

The protective cover 14 is positioned over the inlet 28 and outlet 30 ports, the semicircular top portion 36 of the u-shaped handle 18 and the generally flat top surfaces 20*a* and 20*b* of the distal end 16. The semicircular top portion 36 is designed to be contiguous with the semicircular notches 52*a* and 52*b* that are disposed on each of the first pair of side portions 42*a* and 42*b* respectively.

The third distance $D_3$ is about equal to the fourth distance $D_4$. Since the distances $D_3$ and $D_4$ are about equal, an interference fit is created between the outer surfaces 58*a* and 58*a*' of the cover 14 and the semicircular top portion 36 of the handle 18. The range of the interference fit is about (0.002) mm-(0.005) mm.

The interference fit keeps the cover 14 positioned over the radionuclide generator 12 so that the inlet and outlet connector assemblies 32*a* and 32*b* are protected from any damage that may occur during handling. In use, the protective cover 14 may be removed by holding the protective cover 14 and lifting it off of the assembly 10. The protective cover 14 is secured to the assembly 10 such that it is held snug enough that the protective cover 14 will not fall off during handling.

Figure 6:
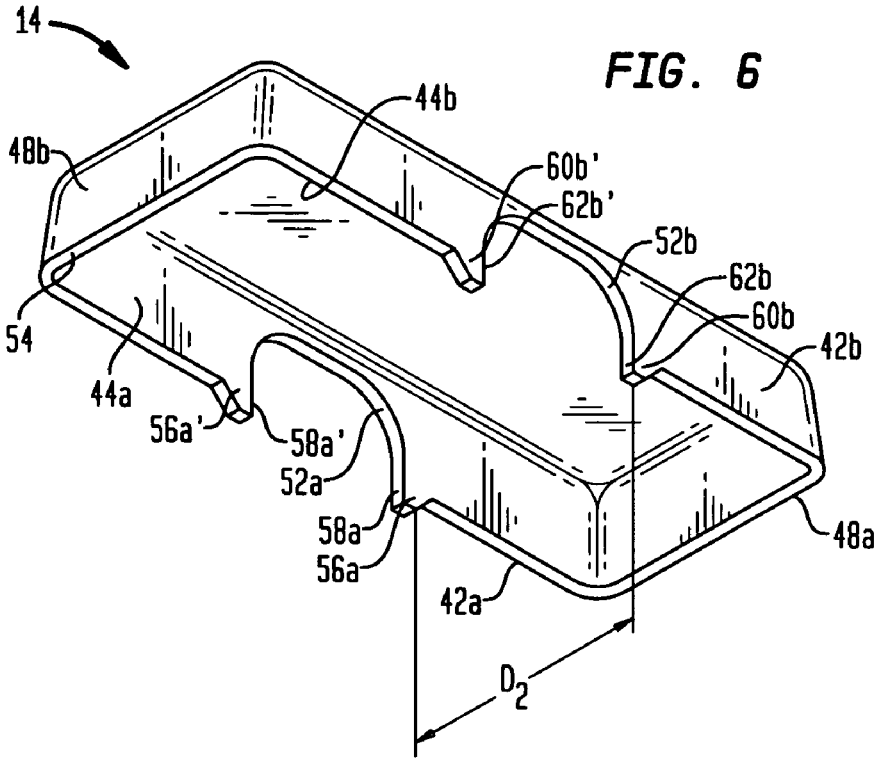
FIG. 6 is a perspective view of an alternate embodiment of a protective housing of the present invention.

Referring to FIG. 6, there is shown an alternate embodiment of the protective cover 14. In this embodiment, the protective cover is the same as described above except the second side portion 42*b* may optionally provide two additional struts 60*b* and 60*b*'. The two additional struts 60*b* and 60*b*' are configured the same as struts 56*a* and 56*a*' described above. A second distance $D_2$ lies between struts 56*a*, 56*a*', 60*b* and 60*b*'.

Since the distances $D_1$ and $D_2$ are about equal, a further interference fit is created between struts 56*a*, 56*a*', 60*b* and 60*b*' of the cover 14 and the generally rectangular top surfaces 20*a* and 20*b* of the radionuclide generator 12. The range of the interference fit is about (0.002) mm-(0.005) mm.

The engagement prevents removal of the cover 14 from the radionuclide generator 12 unless so desired by a user, such as a diagnostician.

Figure 7:
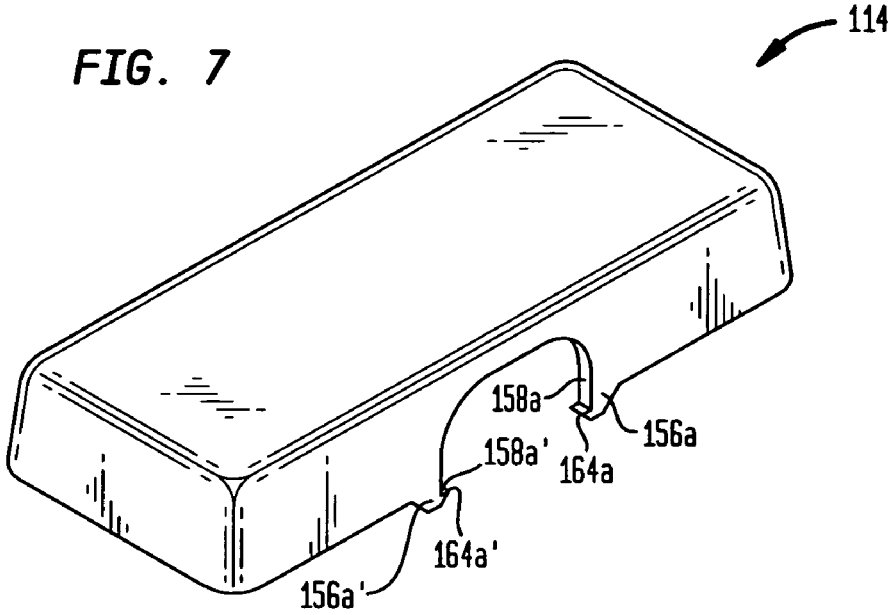
FIG. 7 is a perspective view of an alternate embodiment of a protective housing of the present invention.

Referring to FIG. 7, there is shown an alternate embodiment of the protective cover. Protective cover 114 is identical to the protective cover 14 that was described in connection with FIG. 3 above except that struts 156*a* and 156*a*' have ribs 164*a* and 164*a*' that are disposed on outer surfaces 158*a* and 158*a*'. The ribs 164*a* and 164*a*' latch and engage the bottom portion 34 of the handle 18. The engagement further prevents removal of the cover 114 from the radionuclide generator 12 unless so desired by a user.

Figure 8:
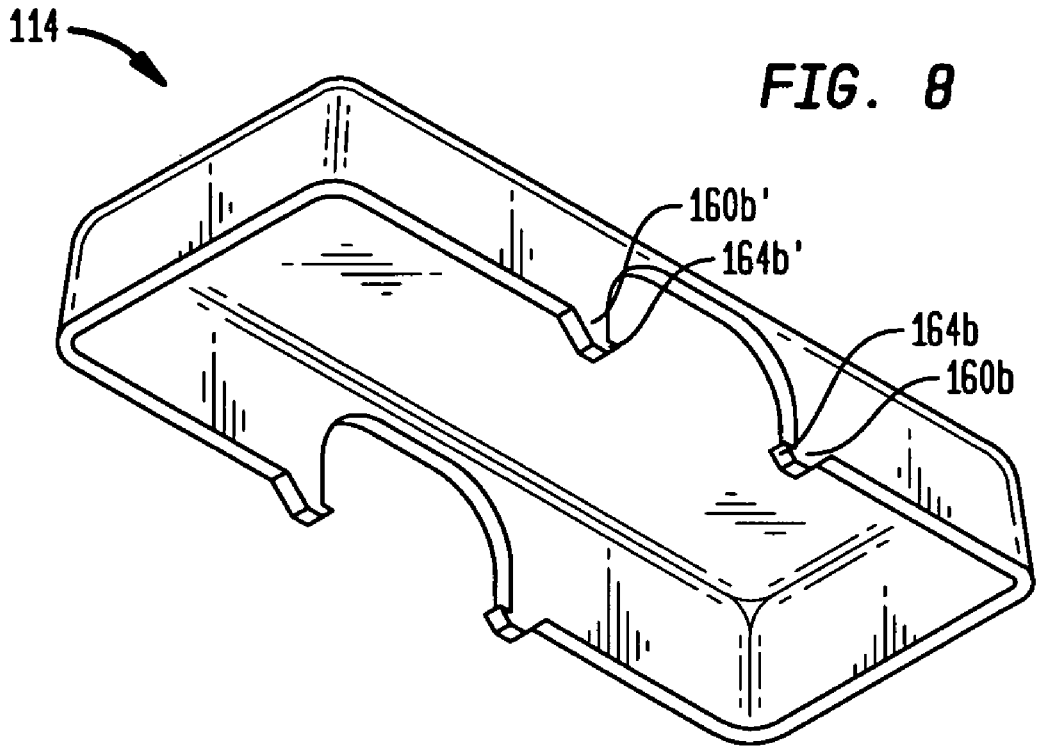
FIG. 8 is a perspective view of an alternate embodiment of a protective housing of the present invention.

Referring to FIG. 8, there is shown another alternate embodiment of the protective cover. The protective cover 114 in this embodiment is the same as the protective cover disclosed in connection with FIG. 7, except the protective cover 114 may include two additional struts 160*b* and 160*b*' that have two additional corresponding ribs 164*b* and 164*b*'. The additional ribs 164*b* and 164*b*' latch and engage the bottom portion 34 of the handle 18. This engagement additionally prevents removal of the protective cover 114 from the radionuclide generator 12 unless so desired by the user.

The invention claimed is:

1. A radionuclide generator assembly comprising:

a) a radionuclide generator having a distal end; an inlet port; an inlet connector assembly; an outlet port and an outlet connector assembly and b) a protective cover removably fixed at the distal end, wherein the protective cover covers the inlet and outlet ports and the inlet and outlet connector assemblies and protects them from being crushed or kinked when the radionuclide generator is not in use.

2. The radionuclide generator assembly according to claim 1 wherein the cover comprises a radioactive resistant polypropylene.

3. A cover and radionuclide generator assembly comprising:

a) a radionuclide generator comprising:

1) a bucket; and 2) a distal end having a generally flat top surface with an inlet port; an inlet connector assembly; and outlet port and an outlet connector assembly; and b) a protective cover removably fixed positioned over the generally flat top surface wherein the protective cover covers the inlet and outlet ports and the inlet and outlet connector assemblies and protects them from being crushed or kinked when the radionuclide generator is not in use.

4. The cover and radionuclide generator assembly according to claim 3 wherein the cover comprises a radioactive resistant polypropylene.

5. A protective cover for a radionuclide generator comprising:

a) a housing which covers the inlet and outlet ports as well as the inlet and outlet connector assemblies of the radionuclide generator;

b) struts for releasably engaging the radionuclide generator, wherein the protective cover covers the inlet and outlet ports and the inlet and outlet connector assemblies and protects them from being crushed or kinked.

6. The protective cover of claim 5, wherein:

a) the housing has a distal end and comprises:

1) a generally flat top surface;

2) a first pair of side portions connected to the top surface;

3) a second pair of side portions connected to the top surface;

4) a semicircular notch disposed on each of the pair of first side portions; and 5) a bottom surface connected to the first and second pairs of side portions; and b) at least two struts are connected to the bottom surface and projecting away from the generally flat top surface of the housing.

7. The cover according to claim 6 in combination with a radionuclide generator, the radionuclide generator comprising:

a) an inlet port entering the radionuclide generator from a generally flat top surface;

b) an outlet port exiting the radionuclide generator from a generally flat top surface;

c) an inlet connector assembly entering the radionuclide generator through the inlet port;

d) an outlet connector assembly exiting the radionuclide generator through the outlet port;

e) a u-shaped handle connected to the bucket, the u-shaped handle having a bottom portion and a semicircular top portion designed to be contiguous with the semicircular notch disposed on each of the first pair of side portions of the protective cover.

8. The combination according to claim 7 wherein the at least two struts further comprise a ribbed portion.

9. The combination according to claim 8 wherein the ribbed portion of the at least two struts engage the bottom portion of the handle of the bucket such that the engagement prevents the cover from being removed from the handle.

10. The protective cover according to claim 6 wherein the cover is made from a radioactive resistant polypropylene.

11. The protective cover according to claim 6 wherein the at least two struts further comprise four struts.

12. The protective cover according to claim 11 wherein each of the four struts further comprises a ribbed portion.

13. A combination protective cover and a radionuclide generator assembly comprising:

a) a radionuclide generator having;

1) a bucket;

2) a distal end having two generally flat top surfaces, the two generally flat top surfaces having a first distance D1;

3) an inlet port entering from the generally flat top surface;

4) an outlet port exiting from the generally flat top surface; and 5) an inlet connector assembly entering the radionuclide generator through the inlet port;

6) an outlet connector assembly exiting the radionuclide generator through the outlet port; and 7) a handle connected to the bucket, the handle having a bottom portion and a semicircular top portion, the semicircular top portion having a third distance $D_3$;

b) a protective cover positioned over the inlet and outlet ports and the inlet and outlet connector assemblies, the semicircular top portion of the handle and the generally flat top surface of the distal end, the protective cover comprising:

1) a generally rectangular housing comprising:

a) a top portion;

b) a first pair of side portions having corresponding inner surfaces, the first pair of side portions connected to the top portion and having a second distance $D_2$ that lies between the inner surfaces;

c) a second pair of side portions connected to the top portion;

d) a semicircular notch on each of the first pair of side portions; and e) a bottom surface connected to the first and second pairs of side portions; and 2) at least two struts connected to the bottom surface and projecting away from the top portion, the at least two struts having;

a) an outer surface; and b) a fourth distance $D_4$ that lies between the outer surfaces;

wherein the first distance $D_1$ is about equal to the second distance $D_2$ and the third distance $D_3$ is about equal to the fourth distance $D_4$;

wherein the about equal distances $D_1$ and $D_2$ provide an interference fit between the at least two struts and the generally rectangular top surface and the about equal distances $D_3$ and $D_4$ provide an interference fit between the outer surfaces of the struts and the semicircular top portion of the handle; and wherein the protective cover covers the inlet and outlet ports and the inlet and outlet connector assemblies and protects them from being crushed or kinked.

14. A combination protective cover and a radionuclide generator assembly comprising:

a) a radionuclide generator having;

1) a bucket containing a lead liner and a column of radionuclide;

2) a distal end having a generally flat top surface and generally rounded side surfaces, the generally flat top surface having a first distance $D_1$;

3) an inlet port entering from the generally flat top surface;

4) an outlet port exiting from the generally flat top surface;

5) an inlet connector assembly entering the radionuclide generator through the inlet port;

6) an outlet connector assembly exiting the radionuclide generator through the outlet port; and 7) a handle connected to the bucket, the handle having a bottom portion and a semicircular top portion having a third distance $D_3$;

b) a protective cover positioned over the inlet and outlet ports and the inlet and outlet connector assemblies, the semicircular top portion of the handle and the generally flat top surface of the distal end, the protective cover comprising:

1) a generally rectangular housing comprising:

a) a top portion;

b) a first pair of side portions having corresponding inner surfaces, the first pair of side portions connected to the top portion and having a second distance $D_2$ that lies between the inner surfaces;

c) a second pair of side portions connected to the top portion;

d) a semicircular notch disposed on each of the first pair of side portions; and e) a bottom edge; and 2) at least two struts connected to the bottom surface and projecting away from the top portion, each strut having;

a) an outer surface;

b) a rib disposed on the outer surface; and c) a fourth distance $D_4$ lying between the outer surfaces; and wherein the first distance $D_1$ is about equal to the second distance $D_2$ and the third distance $D_3$ is about equal to the fourth distance $D_4$; and wherein the about equal distances $D_1$ and $D_2$ provide an interference fit between the at least two struts and the generally rectangular top surface and the about equal distances $D_3$ and $D_4$ provide an interference fit between the outer surfaces of the struts and the semicircular top portion of the handle; and wherein the ribbed portion of each strut latches and engages the bottom portion of the handle such that the engagement prevents removal of the cover from the radionuclide generator; and wherein the protective cover covers the inlet and outlet ports and the inlet and outlet connector assemblies and protects them from being crushed or kinked.

15. The combination according to claim 14 wherein the cover is made from a radioactive resistant polypropylene.

* * * * *